US010393054B2

(12) United States Patent
Sugimoto

(10) Patent No.: US 10,393,054 B2
(45) Date of Patent: Aug. 27, 2019

(54) ENGINE CONTROLLER FOR DETECTING FAILURE OF FUEL INJECTOR

(71) Applicant: Toyota Jidosha Kabushiki Kaisha, Toyota-shi Aichi-ken (JP)

(72) Inventor: Hitoki Sugimoto, Toyota (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 36 days.

(21) Appl. No.: 15/231,014

(22) Filed: Aug. 8, 2016

(65) Prior Publication Data

US 2017/0058820 A1 Mar. 2, 2017

(30) Foreign Application Priority Data

Sep. 2, 2015 (JP) ..... 2015-172947

(51) Int. Cl.
*F02D 41/30* (2006.01)
*F02D 41/22* (2006.01)
(Continued)

(52) U.S. Cl.
CPC ..... *F02D 41/3094* (2013.01); *F02D 41/1498* (2013.01); *F02D 41/221* (2013.01);
(Continued)

(58) Field of Classification Search
CPC ..... F02D 41/3094; F02D 41/1498; F02D 41/221; F02D 2200/1015; F02D 41/0065; F02D 2041/224; F02D 41/30; F02D 41/22; F02D 41/0002; F02M 63/02; F02M 69/046; F02M 21/0284; Y02T 10/44; Y02T 10/47; Y02T 10/123; Y02T 10/42; G01M 15/11; G01M 15/046
(Continued)

(56) References Cited

U.S. PATENT DOCUMENTS

2013/0158841 A1* 6/2013 Ito ..... F02D 41/0085 701/104
2013/0174806 A1* 7/2013 Nagakura ..... F02B 17/005 123/296
2015/0144116 A1* 5/2015 Anzawa ..... F02D 41/3094 123/676

FOREIGN PATENT DOCUMENTS

JP 2009-222018 A 10/2009
JP 2013-108485 A 6/2013
(Continued)

*Primary Examiner* — Joseph J Dallo
*Assistant Examiner* — Scott A Reinbold
(74) *Attorney, Agent, or Firm* — Dinsmore & Shohl LLP

(57) ABSTRACT

A controller of an engine performs a failure diagnosis process for an injection valve. The failure diagnosis process increases a misfire count of the engine when a variation in rotation of the engine is equal to or greater than a predetermined variation in every predetermined cycle, and determines that the injection valve has a failure when the misfire count is equal to or greater than a first predetermined number of times over a predetermined time period. The controller determines that the multi-cylinder engine is in a predetermined load operation cycle if a volume efficiency of the multi-cylinder engine is less than a reference value, and the controller determines whether continuation of the injection mode is needed based on a comparison of the misfire count and a second predetermined number of times, wherein the second predetermined number of times is less than the first predetermined number of times.

5 Claims, 4 Drawing Sheets

(51) Int. Cl.
*F02D 41/14* (2006.01)
*F02M 63/02* (2006.01)
*F02D 41/00* (2006.01)

(52) U.S. Cl.
CPC ..... *F02M 63/02* (2013.01); *F02D 41/0065* (2013.01); *F02D 2041/224* (2013.01); *F02D 2200/1015* (2013.01)

(58) Field of Classification Search
USPC ..... 123/478
See application file for complete search history.

(56) References Cited

FOREIGN PATENT DOCUMENTS

| | | | | | |
|---|---|---|---|---|---|
| JP | 2015-101983 | A | | 6/2015 | |
| JP | 2015101983 | A | * | 6/2015 | ..... F02D 41/3094 |
| JP | 2015101983 | A | * | 6/2015 | ..... F02D 41/3094 |

* cited by examiner

ENGINE CONTROLLER FOR DETECTING FAILURE OF FUEL INJECTOR

CROSS-REFERENCE TO RELATED APPLICATIONS

The present application claims priority to Japanese Patent Application No. 2015-172947 filed Sep. 2, 2015, the entire contents of which are hereby incorporated by reference.

TECHNICAL FIELD

The present disclosure relates to an engine apparatus.

BACKGROUND ART

In a configuration of an engine apparatus including an engine equipped with a direct injection injector and a port injector, a proposed technique stops fuel injection from the port injector and allows for fuel injection from only the direct injection injector when the rotation speed of the engine is in a predetermined rotation speed range and the amount of the air supplied to the engine is in a predetermined air flow range. This proposed technique determines that the direct injection injector has a failure in response to detection of a misfire of the engine (for example, Patent Literature 1).

CITATION LIST

Patent Literature

PTL 1: JP 2015-101983A

SUMMARY

When the engine has a relatively low load, the engine apparatus of such configuration may operate the engine in an in-cylinder injection mode where the fuel is injected from only the direct injection injector or in a port injection mode where the fuel is injected from only the port injector. The relatively low load of the engine provides a relatively small variation in torque (rotation speed) between cylinders on the occurrence of a misfire in the engine. This is likely to provide a relatively low detection accuracy of a misfire. Especially a relatively low operation frequency of the engine in the in-cylinder injection mode or in the port injection mode (relatively short duration when in the in-cylinder injection mode or the port injection mode is continued) relatively reduces the opportunities of performing the failure diagnosis process for the direct injection injector or the port injector. This may result in late detection of a failure of the direct injection injector or the port injector.

With regard to an engine apparatus including an engine equipped with an in-cylinder injection valve and a port injection valve, an object is to ensure more reliable detection of a failure of the in-cylinder injection valve or the port injection valve.

In order to achieve the above primary object, the engine apparatus of the present disclosure employs the following configuration.

The present disclosure is directed to an engine apparatus. The engine apparatus includes a multi-cylinder engine that includes an in-cylinder injection valve provided to inject a fuel in a cylinder and a port injection valve provided to inject the fuel into an intake port; and a controller that is configured to control the engine. In an in-cylinder injection mode where the fuel is injected from only the in-cylinder injection valve or in a port injection mode where the fuel is injected from only the port injection valve, the controller performs a failure diagnosis process for the in-cylinder injection valve or the port injection valve, wherein the failure diagnosis process increases a misfire count of the engine when a variation in rotation of the engine is equal to or greater than a predetermined variation in every predetermined cycle, and determines that the in-cylinder injection valve or the port injection valve has a failure when the misfire count is equal to or greater than a predetermined number of times after elapse of a predetermined time period that is longer than the predetermined cycle. The controller increases a likelihood that the in-cylinder injection mode or the port injection mode is likely to be continued when the engine has a long light load operation time in the failure diagnosis process, compared with the likelihood when the engine has a short light load operation time.

In the in-cylinder injection mode where the fuel is injected from only the in-cylinder injection valve or in the port injection mode where the fuel is injected from only the port injection valve, the engine apparatus of this aspect performs the failure diagnosis process for the in-cylinder injection valve or the port injection valve. The failure diagnosis process increases the misfire count of the engine when the variation in rotation of the engine is equal to or greater than the predetermined variation in every predetermined cycle, and determines that the in-cylinder injection valve or the port injection valve has a failure when the misfire count is equal to or greater than the predetermined number of times after elapse of the predetermined time period that is longer than the predetermined cycle. The likelihood that the in-cylinder injection mode or the port injection mode is likely to be continued is increased when the engine has the long light load operation time in the failure diagnosis process, compared with the likelihood when the engine has a short light load operation time. This increases the opportunities of performing the failure diagnosis process for the in-cylinder injection valve or the port injection valve in the case of a relatively long light load operation time and thereby ensures the more reliable detection of a failure of the in-cylinder injection valve or the port injection valve. The "light load operation time" means a time period when the engine is operated at the volume efficiency of not higher than a predetermined volume efficiency.

DETAILED DESCRIPTION

The following describes some aspects of the present disclosure with reference to embodiments.

Figure 1:
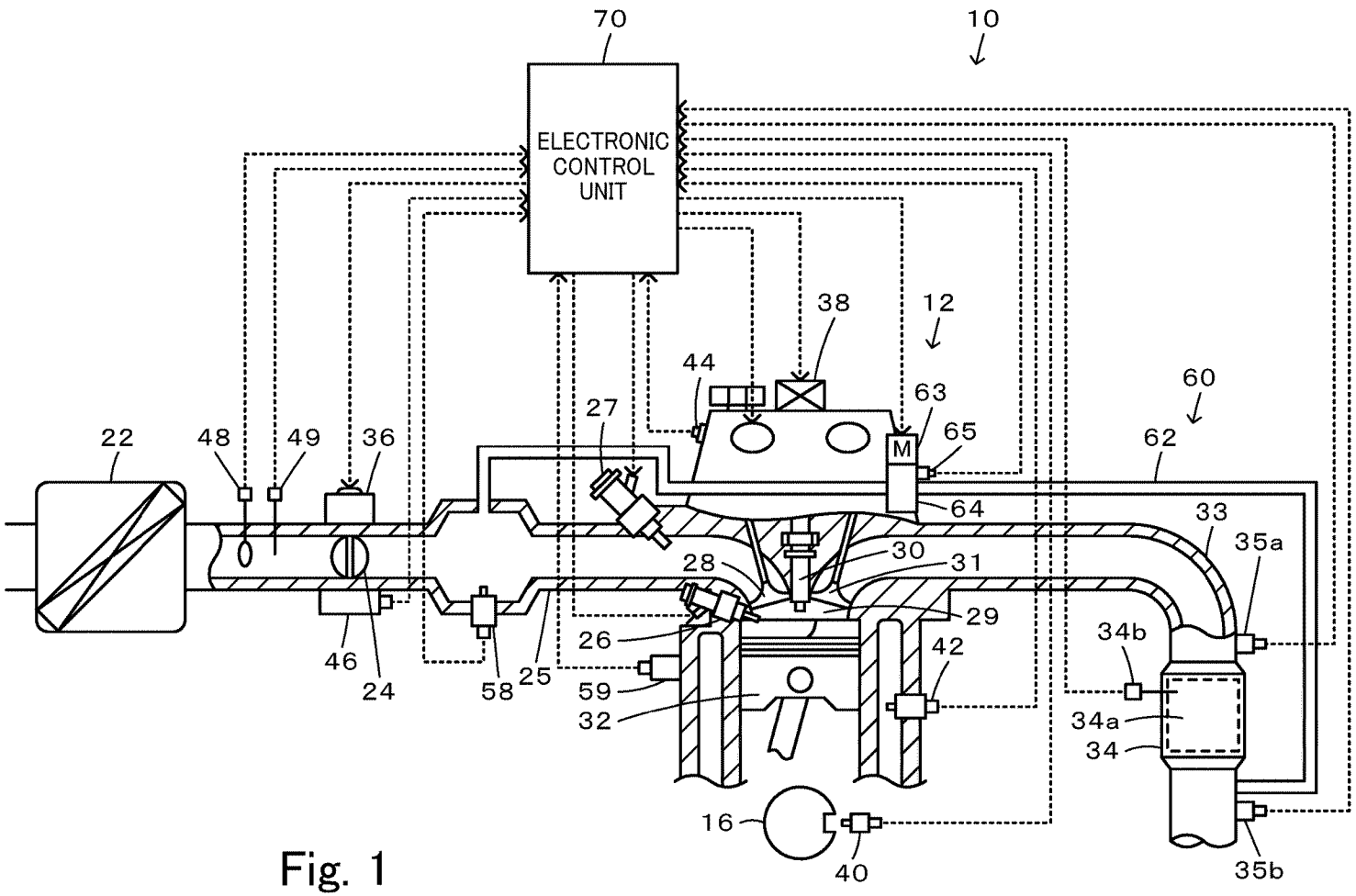
FIG. 1 is a configuration diagram illustrating the schematic configuration of an engine apparatus according to one embodiment of the present disclosure.

FIG. 1 is a configuration diagram illustrating the schematic configuration of an engine apparatus 10 according to one embodiment of the present disclosure. As illustrated, the engine apparatus 10 of the embodiment includes an engine 12 and an electronic controller 70 configured to operate and control the engine 12. This engine apparatus 10 may be mounted on, for example, a hybrid vehicle equipped with the engine 12 and a motor (not shown) or a vehicle driven using only the power from the engine 12.

The engine 12 is configured as a four-cylinder engine to output power in four strokes, i.e., intake, compression, expansion and exhaust, using a fuel such as gasoline or light oil. This engine 12 includes in-cylinder injectors 26 provided as in-cylinder injection valves to inject the fuel into each cylinder and a port injector 27 provided as a port injection valve to inject the fuel into an intake port and is operated in any of a plurality of injection modes, i.e., a port injection mode, an in-cylinder injection mode and a combined injection mode. The port injection mode denotes an injection mode in which the fuel is injected from only the port injector 27. The in-cylinder injection mode denotes an injection mode in which the fuel is injected from only the in-cylinder injectors 26. The combined injection mode denotes an injection mode in which the fuel is injected from both the in-cylinder injectors 26 and the port injector 27. In the port injection mode, while the air cleaned by an air cleaner 22 is taken into an intake pipe 25, the fuel is injected from the port injector 27 into the intake pipe 25, so that the fuel is mixed with the air. This air-fuel mixture is sucked into a combustion chamber 29 via an intake valve 28 and is explosively combusted with electric spark generated by an ignition plug 30. The reciprocating motion of a piston 32 pressed down by the energy of explosive combustion is converted into the rotational motion of a crankshaft 16. In the in-cylinder injection mode, while the air is sucked into the combustion chamber 29, the fuel is injected from the in-cylinder injector 26 in the middle of the intake stroke or in the compression stroke. The air-fuel mixture is then explosively combusted with electric spark generated by the ignition plug 30 to provide the rotational motion of the crankshaft 16. In the combined injection mode, while the air is sucked into the combustion chamber 29, the fuel is injected from the port injector 27 and is also injected from the in-cylinder injector 26 in the intake stroke or in the compression stroke. The air-fuel mixture is then explosively combusted with electric spark generated by the ignition plug 30 to provide the rotational motion of the crankshaft 16. The exhaust gas discharged from the combustion chamber 29 into an exhaust pipe 33 is released to the outside air through a catalytic converter 34 that is filled with a conversion catalyst (three-way catalyst) 34*a* to convert toxic components such as carbon monoxide (CO), hydrocarbons (HC) and nitrogen oxides (NOx) to less toxic components. The exhaust gas is not fully discharged to the outside air but is partly supplied to the intake pipe 25 via an exhaust gas recirculation system (hereinafter referred to as EGR system) 60 that is configured to recirculate the exhaust gas into the intake air. The EGR system 60 includes an EGR pipe 62 and an EGR valve 64. The EGR pipe 62 is arranged to connect the downstream side of the catalytic converter 34 in the exhaust pipe 33 with a surge tank in the intake pipe 25. The EGR valve 64 is placed in the EGR pipe 62 and is driven by a stepping motor 63. This EGR system 60 regulates the recirculation amount of the exhaust gas as uncombusted gas by adjusting the opening position of the EGR valve 64 and recirculates the regulated amount of the exhaust gas to the intake side. The engine 12 is configured to suck the mixture of the air, the exhaust gas and the fuel into the combustion chamber 29 as described above. In the description below, the exhaust gas recirculated from the exhaust pipe 33 into the intake pipe 25 is called EGR gas, and the amount of the EGR gas is called EGR amount.

The electronic controller 70 is implemented by a CPU-based microprocessor and includes a ROM that stores processing programs, a RAM that temporarily stores data ad input and output ports, in addition to the CPU, although not being specifically illustrated. The electronic controller 70 inputs, via its input port, signals input from various sensors required for operation control of the engine 12. The signals input into the electronic controller 70 include:

crank angle θcr from a crank position sensor 40 configured to detect the rotational position of the crankshaft 16;

cooling water temperature Tw from a water temperature sensor 42 configured to detect the temperature of cooling water of the engine 12;

cam angles θci and θco from a cam position sensor 44 configured to detect the rotational position of an intake cam shaft to open and close the intake valve 28 and the rotational position of an exhaust cam shaft to open and close an exhaust valve 31;

throttle position TH from a throttle valve position sensor 46 configured to detect the position of a throttle valve 24 provided in the intake pipe 25;

amount of intake air Qa from an air flowmeter 48 mounted to the intake pipe 25;

intake air temperature Ta from a temperature sensor 49 mounted to the intake pipe 25;

intake pressure Pin from an intake pressure sensor 58 configured to detect the internal pressure of the intake pipe 25;

catalyst temperature Tc from a temperature sensor 34*b* configured to detect the temperature of the conversion catalyst 34*a* in the catalytic converter 34;

air-fuel ratio AF from an air-fuel ratio sensor 35*a* mounted to the exhaust pipe 33;

oxygen signal $O_2$ from an oxygen sensor 35*b* mounted to the exhaust pipe 33;

knocking signal Ks from a knocking sensor 59 mounted to a cylinder block and configured to detect a vibration induced by the occurrence of knocking; and EGR valve position EV from an EGR valve position sensor 65 configured to detect the opening position of the EGR valve 64.

The electronic controller 70 outputs, via its output port, various control signals for operation control of the engine 12. The signals output from the electronic controller 70 include:

drive control signal to a throttle motor 36 configured to adjust the position of the throttle valve 24;

drive control signals to the in-cylinder injectors 26;

drive control signal to the port injector 27;

drive control signals to ignition coils 38 integrated with igniters; and control signal to the stepping motor 63 configured to adjust the opening position of the EGR valve 64.

The electronic controller 70 computes the rotation speed of the crankshaft 16 or, in other words, a rotation speed Ne of the engine 12, based on the crank angle θcr from the crank position sensor 40. The electronic controller 70 also computes a volume efficiency (ratio of the volume of the air actually taken in one cycle to the stroke volume per cycle of the engine 12) KL as a load of the engine 12, based on the amount of intake air Qa from the air flowmeter 48 and the rotation speed Ne of the engine 12.

In the engine apparatus 10 of the embodiment having the above configuration, the electronic controller 70 performs, for example, intake air flow control, fuel injection control, ignition control and EGR control of the engine 12, so as to output a required power Te* from the engine 12. The intake air flow control, the ignition control and the EGR control are not characteristics of the present disclosure and are thus not described in detail herein.

The fuel injection control first sets an injection mode (port injection mode, in-cylinder injection mode or combined injection mode), based on the volume efficiency KL. The fuel injection control subsequently sets target fuel injection amounts Qf*[DI, 1]-Qf*[DI, 4], [PFI, 1]-[PFI, 4] of the in-cylinder injectors 26 and the port injector 27 with regard to respective four cylinders [1] to [4] (numerals in brackets denote cylinder numbers (indicating the order of ignition)), based on the amount of intake air Qa and the set injection mode, so as to make the air-fuel ratio in each of the cylinders [1] to [4] satisfy a target air-fuel ratio (for example, stoichiometric air-fuel ratio). The fuel injection control then drives and controls the in-cylinder injectors 26 and/or the port injector 27 with regard to the respective cylinders [1] to [4] to achieve fuel injection with the target fuel injection amounts Qf*[DI, 1]-Qf*[DI, 4], [PFI, 1]-[PFI, 4].

The injection mode is set to the in-cylinder injection mode, the combined injection mode or the port injection mode in the ascending order of the volume efficiency KL. The in-cylinder injection mode is set in an area where the volume efficiency KL is less than a reference value KLref1. The reference value KLref1 denotes a lower limit in a range of the volume efficiency KL where EGR control is performed and may be, for example, 23%, 25% or 27%. The in-cylinder injection mode is set only in an area where EGR control is not performed (in other words, the in-cylinder injection mode is not set in an area where EGR control is performed). This is because setting the in-cylinder injection mode in the area where EGR control is performed (not to inject the fuel from the port injector 27) is likely to cause a deposit due to the EGR gas to adhere to and to be accumulated at an outlet of the port injector 27. EGR control is not performed in the area where the volume efficiency KL is less than the reference value KLref1. This is attributed to difficulty in controlling the EGR amount due to a relatively high negative pressure in the intake pipe 25 in the area having relatively low volume efficiency KL.

Figure 2:
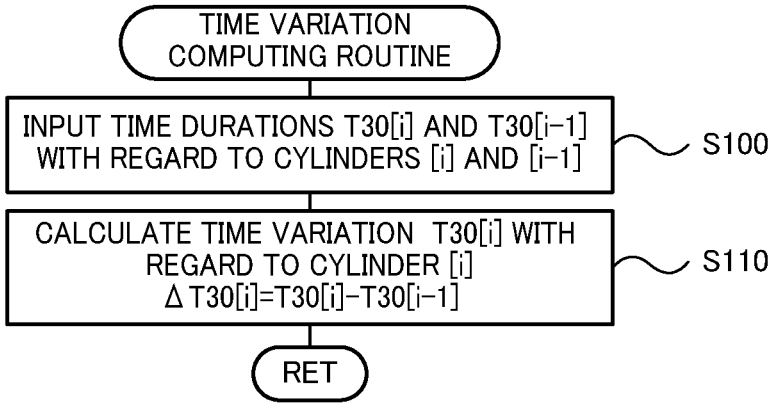
FIG. 2 is a flowchart showing one example of time variation computing routine performed by the electronic controller.
Figure 3:
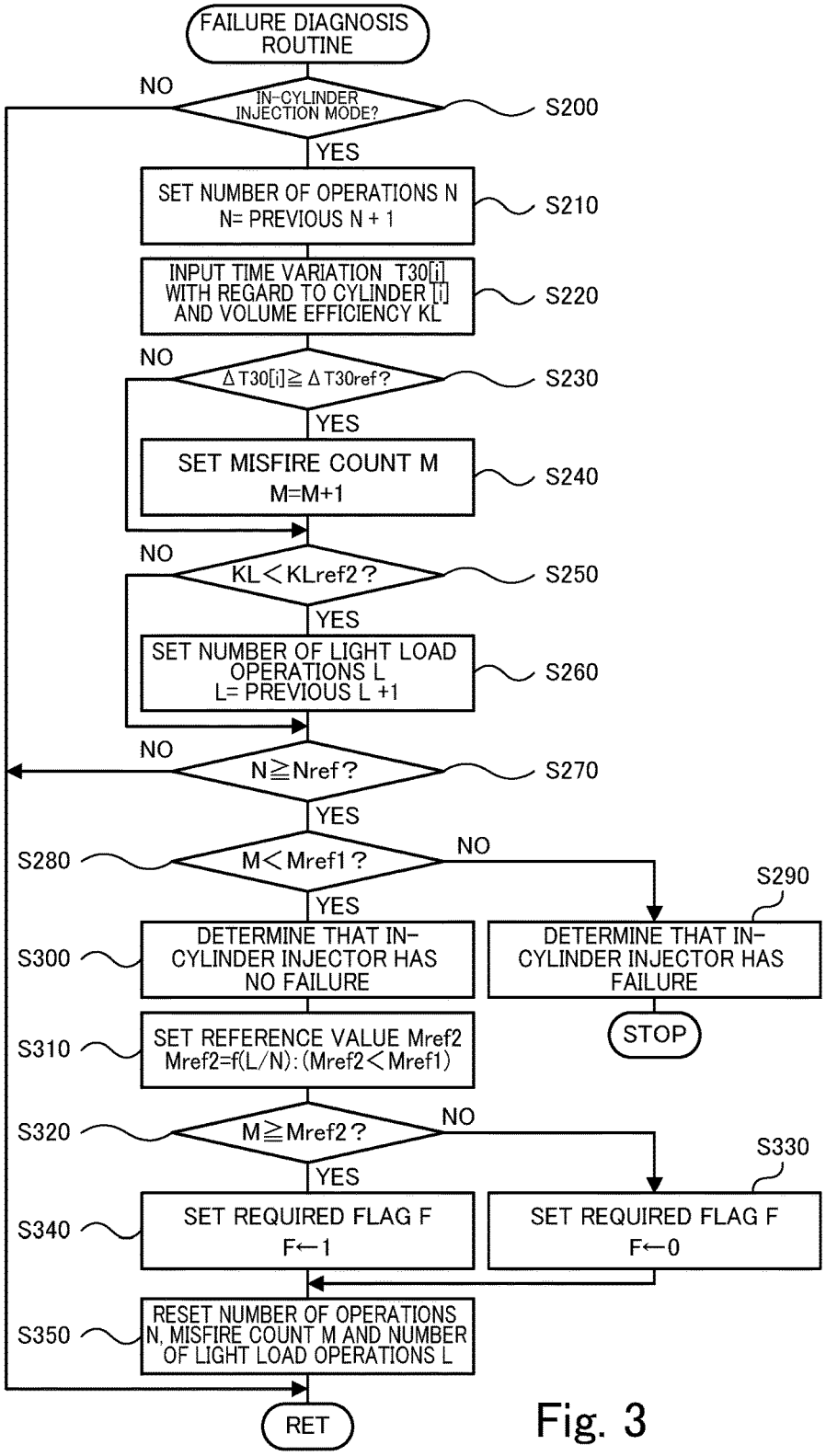
FIG. 3 is a flowchart showing one example of failure diagnosis routine performed by the electronic controller.

The following describes operations of the engine apparatus 10 of the embodiment having the above configuration or more specifically series of operations in a failure diagnosis process for the in-cylinder injectors 26 of the engine 12. FIG. 2 is a flowchart showing one example of time variation computing routine performed by the electronic controller 70. FIG. 3 is a flowchart showing one example of failure diagnosis routine performed by the electronic controller 70. These routines are sequentially described below.

The time variation computing routine of FIG. 2 is described first. This routine is performed every time a time duration T30 is computed with regard to each cylinder. The time duration T30 denotes a time period required to rotate the crankshaft 16 by 30 degrees. According to this embodiment, the time duration T30 with regard to each cylinder is determined by measuring a time period required to rotate the crank angle θcr measured by the crank position sensor 40 by 30 degrees from the top dead center of each cylinder. Accordingly, this routine is performed at every ignition cycle. The embodiment uses the four-cylinder engine 12, and ignition is performed in one of the cylinders at every 180 degrees as the rotational angle of the crankshaft 16. Accordingly, the "ignition cycle" corresponds to 180 degrees as the rotational angle of the crankshaft 16.

When the time variation computing routine of FIG. 2 is started, the electronic controller 70 first inputs time durations T30[*i*] and T30[*i*−1] with regard to cylinders [i] and [i−1] (step S100). The cylinders [i] and [i−1] respectively denote a cylinder corresponding to a latest computed time duration T30 and a cylinder corresponding to a time duration T30 computed in a previous ignition cycle (i.e., cylinders in the expansion stroke at the time of computation of the time duration T30[*i*] and the time duration T30[*i*−1]). The combination of the cylinders [i] and [i−1] is accordingly one of ([1], [4]), ([2], [1]), ([3], [2]), and ([4], [3]).

The electronic controller 70 subsequently subtracts the time duration T30 [i−1] with regard to the cylinder [i−1] from the time duration T30[*i*] with regard to the cylinder [i], so as to calculate a time variation ΔT30[*i*] with regard to the cylinder [i] (step S110) and then terminates this routine.

The failure diagnosis routine of FIG. 3 is described next. This routine is performed every time the time variation ΔT30[*i*] is calculated by the time variation computing routine of FIG. 2 (at every ignition cycle) when no failure of the in-cylinder injectors 26 has been detected.

When the failure diagnosis routine of FIG. 3 is started, the electronic controller 70 first determines whether the engine 12 is operated in the in-cylinder injection mode (step S200). When it is determined that the engine 12 is operated in the injection mode other than the in-cylinder injection mode (i.e., either in the port injection mode or in the combined injection mode), the electronic controller 70 immediately terminates this routine.

When it is determined at step S200 that the engine 12 is operated in the in-cylinder injection mode, the electronic controller 70 performs a failure diagnosis process for the in-cylinder injectors 26 of the engine 12 (steps S210 to S300).

In the failure diagnosis process, the electronic controller 70 first increments a number of operations N that denotes a number of executions of this routine during operation of the engine 12 in the in-cylinder injection mode, by value 1 (step S210). The number of operations N is set to value 0 as an initial value at the start of operation of the engine 12 and is reset to the value 0 by the processing of step S350 described later.

The electronic controller 70 subsequently inputs data, for example, the time variation ΔT30[*i*] with regard to the cylinder [i] and the volume efficiency KL (step S220). The time variation ΔT30[*i*] with regard to the cylinder [i] input here is the value computed by the time variation computing routine of FIG. 2. The volume efficiency KL input here is the value computed based on the amount of intake air Qa and the rotation speed Ne of the engine 12.

After inputting the data, the electronic controller 70 compares the input time variation ΔT30 [i] with regard to the cylinder [i] with a reference value ΔT30ref (step S230). The reference value ΔT30ref denotes a threshold value used to determine whether the cylinder [i] has a misfire and may be determined based on the rotation speed Ne and the volume efficiency KL of the engine 12.

When the time variation ΔT30[*i*] with regard to the cylinder [i] is equal to or greater than the reference value ΔT30ref, the electronic controller 70 determines that the cylinder [i] has a misfire and increments a misfire count M that denotes a number of misfires of the engine 12 detected in the in-cylinder injection mode, by value 1 (step S240). When the time variation ΔT30 [i] is less than the reference value ΔT30ref, on the other hand, the electronic controller 70 determines that the cylinder [i] has no misfire and keeps the misfire count M unchanged from a previous value. The misfire count M is set to value 0 as an initial value at the start of operation of the engine 12 and is reset to the value 0 by the processing of step S350 described later.

The electronic controller 70 subsequently compares the input volume efficiency KL with a reference value KLref2 (step S250). The reference value KLref2 denotes a threshold value used to determine whether the engine 12 is in light load operation. The reference value KLref2 is a value in a range smaller than the reference value KLref1 described above and may be, for example, 18%, 20% or 22%.

When the volume efficiency KL is less than the reference value KLref2, the electronic controller 70 determines that the engine 12 is in light load operation and increments a number of light load operations L that denotes a number of executions of this routine during operation of the engine 12 in the in-cylinder injection mode, by value 1 (step S260). When the volume efficiency KL is not less than the reference value KLref2, on the other hand, the electronic controller 70 determines that the engine 12 is not in light load operation and keeps the number of light load operations L unchanged from a previous value. The number of light load operations L is set to value 0 as an initial value at the start of operation of the engine 12 and is reset to the value 0 by the processing of step S350 described later.

The electronic controller 70 subsequently compares the number of operations N with a reference value Nref (step S270). The reference value Nref denotes a threshold value used to determine whether a diagnosis timing has come as a timing of diagnosing whether any of the in-cylinder injectors 26 has a failure and may be, for example, 300, 400 or 500. When the number of operations N is less than the reference value Nref, the electronic controller 70 determines that a diagnosis timing has not yet come and terminates this routine.

When the number of operations N is equal to or greater than the reference value Nref at step S270, on the other hand, the electronic controller 70 determines that a diagnosis timing has come and compares the misfire count M with a reference value Mref1 (step S280). The reference value Mref1 is a threshold value used to diagnose (determine) whether the in-cylinder injector 26 (in any of the cylinders of) the engine 12 has a failure and may be, for example, 83, 85 or 87.

When the misfire count M is equal to or greater than the reference value Mref1, the electronic controller 70 determines that the in-cylinder injector 26 of the engine 12 has a failure (step S290) and terminates this routine. In this case, failure information indicating that the in-cylinder injector 26 has a failure may be displayed in the form of a message on a display (not shown) or may be output in the form of an audio message from a speaker (not shown). This enables the driver to be notified of the failure information.

Figure 4:
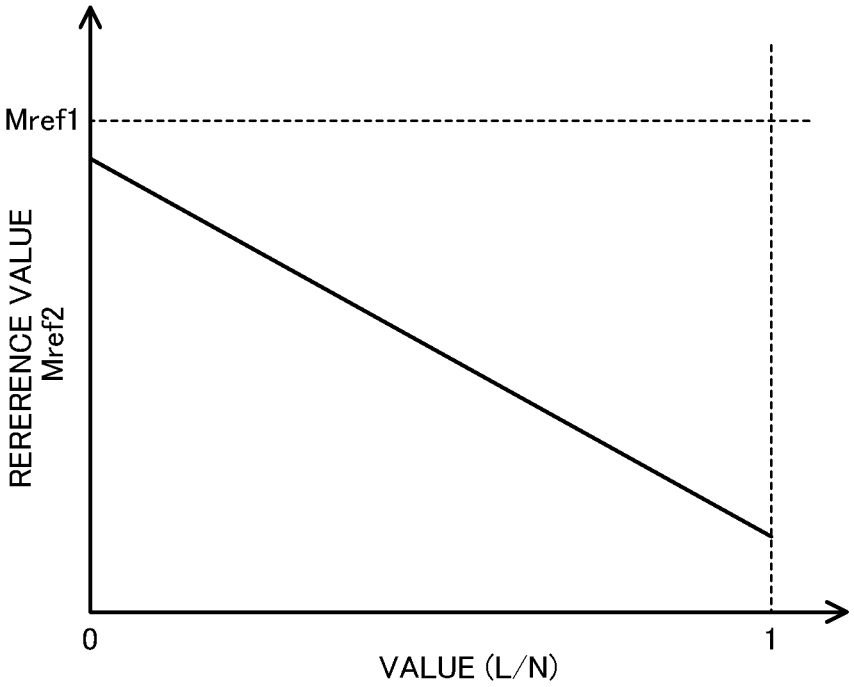
FIG. 4 is one example of the reference value setting map.

When the misfire count M is less than the reference value Mref1, on the other hand, the electronic controller 70 determines that the in-cylinder injector 26 of the engine 12 has no failure (step S300). The electronic controller 70 then sets a reference value Mref2 based on the number of operations N and the number of light load operations L (step S310) and compares the misfire count M with the reference value Mref2 (step S320). The reference value Mref2 is a threshold value used to determine whether continuation of the in-cylinder injection mode is to be needed and is set in a range smaller than the reference value Mref1. According to this embodiment, a procedure may determine in advance a relationship between the reference value Mref2 and a value (L/N) obtained by dividing the number of light load operations L by the number of operations N, store the determined relationship as a reference value setting map in the ROM (not shown) and read the reference value Mref2 corresponding to a given value (L/N) from this map to set the reference value Mref2. One example of the reference value setting map is shown in FIG. 4. As illustrated, the reference value Mref2 is set to provide a smaller value at a larger value (L/N) than a value at a smaller value (L/N) or more specifically set to decrease with an increase in the value (L/N). For example, the reference value Mref2 may be set to for example, 73, 75 or 77 at the value (L/N) equal to value 0 and may be set to, for example, 3, 5 or 7 at the value (L/N) equal to value 1. The reason for setting the reference value Mref2 in this way will be described later.

When the misfire count M is less than the reference value Mref2 at step S320, the electronic controller 70 determines that continuation of the in-cylinder injection mode is not to be needed, sets a required flag F to value 0 (step S330), resets the number of operations N, the misfire count M and the number of light load operations L to the value 0 (step S350) and then terminates this routine. When the required flag F is set to the value 0, the injection mode (port injection mode, in-cylinder injection mode or combined injection mode) is then set, based on the volume efficiency KL as described above.

When the misfire count M is equal to or greater than the reference value Mref2 at step S320, on the other hand, the electronic controller 70 determines that continuation of the in-cylinder injection mode is to be needed, sets the required flag F to value 1 (step S340), resets the number of operations N, the misfire count M and the number of light load operations L to the value 0 (step S350) and then terminates this routine. When the required flag F is set to the value 1, the in-cylinder injection mode is continued irrespective of the volume efficiency KL until completion of a subsequent failure diagnosis process.

The following describes the reason for setting the reference value Mref2 in the tendency of FIG. 4. Setting the reference value Mref2 to provide a smaller value at a larger value (L/N) than a value at a smaller value (L/N) means setting the reference value Mref2 to provide a smaller value at a longer light load operation time of the engine 12 in the failure diagnosis process of the in-cylinder injector 26. This leads to increasing the likelihood that the required flag F is likely to be set to the value 1 at the longer light load operation time than the likelihood at the shorter light load operation time (i.e., increasing the likelihood that the in-cylinder injection mode is more likely to be continued). The light load operation time corresponds to a time period calculated by multiplying the number of light load operations L by an ignition cycle time. A relatively small volume efficiency KL (relatively small load) of the engine 12 provides a smaller variation in torque (rotation speed) between the cylinders on the occurrence of a misfire in the engine 12. This increases the unlikelihood that the time variation $\Delta T30[i]$ with regard to the cylinder [i] is unlikely to become greater than the reference value $\Delta T30$ref and increases the unlikelihood that the misfire counter M is unlikely to be increased. This means that the misfire counter M is unlikely to become equal to or greater than the reference value Mref1 at the diagnosis timing of the failure diagnosis process. Because of this reason, a relatively low frequency of operations of the engine 12 in the in-cylinder injection mode (i.e., relatively short duration) reduces the opportunities of performing the failure diagnosis process for the in-cylinder injector 26. This may result in late detection of a failure of the in-cylinder injector 26. The engine apparatus 10 of the embodiment increases the likelihood that the in-cylinder injection mode is more likely to be continued at the longer light load operation time than the likelihood at the shorter light load operation time. This increases the opportunities of performing the failure diagnosis process for the in-cylinder injector 26 in the case of a relatively long light load operation time and thereby ensures the more reliable detection of a failure of the in-cylinder injector 26. The engine apparatus of the embodiment sets the in-cylinder injection mode only in the area where the volume efficiency KL is less than the reference value KLref1 (i.e., the area where EGR control is not performed). This increases the likelihood that the frequency of setting the in-cylinder injection mode is likely to be reduced. This suggests that increasing the likelihood that the in-cylinder injection mode is more likely to be continued is of greater significance at the longer light load operation time, compared with at the shorter light load operation time.

The engine apparatus 10 of the embodiment described above performs the failure diagnosis process for the in-cylinder injector 26 in the in-cylinder injection mode. The failure diagnosis process increments the misfire count M by the value 1 when the time variation ΔT30[*i*] with regard to the cylinder [i] in each ignition cycle is equal to or greater than the reference value ΔT30ref. The failure diagnosis process determines that the in-cylinder injector 26 has a failure, when the misfire count M is equal to or greater than the reference value Mref1 after the number of operations N becomes equal to or greater than the reference value Nref. When the misfire count M is less than the reference value Mref1 after the number of operations N becomes equal to or greater than the reference value Nref, on the other hand, the failure diagnosis process increases the likelihood that the in-cylinder injection mode is likely to be continued at the longer light load operation time of the engine 12 in the failure diagnosis process than the likelihood at the shorter light load operation time. This increases the opportunities of performing the failure diagnosis process for the in-cylinder injector 26 in the case of a relatively long light load operation time and thereby ensures the more reliable detection of a failure of the in-cylinder injector 26.

When the failure diagnosis process for the in-cylinder injector 26 determines that the in-cylinder injector 26 has no failure, the misfire count M is equal to or greater than the reference value Mref2 and the required flag F is set to the value 1, the engine apparatus 10 of the embodiment continues the in-cylinder injection mode irrespective of the volume efficiency KL until completion of a subsequent failure diagnosis process. A modification may change over the injection mode from the in-cylinder injection mode to the combined injection mode or the port injection mode when the volume efficiency KL becomes equal to or greater than a reference value KLref3 that is greater than the reference value KLref1 in the course of a subsequent failure diagnosis process. The reference value KLref3 may be, for example, 28%, 30% or 32%.

The engine apparatus 10 of the embodiment includes the EGR system 60 and thereby sets the in-cylinder injection mode in the area where the volume efficiency KL is less than the reference value KLref1. The series of processing of steps S310, S320 and S340 in the failure diagnosis routine of FIG. 3 increases the opportunities of performing the failure diagnosis process for the in-cylinder injector 26 in the case of a relatively long light load operation time of the engine 12 in the in-cylinder injection mode. In another configuration of the engine 12, for example, in a configuration without the EGR system 60, the port injection mode may be set in an area where the volume efficiency KL is less than a reference value KLref4 that is close to the reference value Kref1. In this case, a routine similar to the routine of FIG. 3 may be employed to perform a failure diagnosis process of the port injector 27.

The engine apparatus 10 of the embodiment computes the time duration T30 required to rotate the crankshaft 16 by degrees and calculates the time variation ΔT30 based on the computed time duration T30. The rotation angle may be, however, for example, 10 degrees or 20 degrees, instead of 30 degrees.

The engine apparatus 10 of the embodiment calculates the time variation ΔT30[*i*] by subtracting the time duration T30[*i*−1] with regard to the cylinder [i−1] from the time duration T30 [i] with regard to the cylinder [i]. A modification may calculate a time variation ΔT30[*i*] by subtracting a time duration T30[*i*−2] with regard to a cylinder [i−2] from the time duration T30[*i*] with regard to the cylinder [i].

The engine apparatus 10 uses the four-cylinder engine 12 according to the above embodiment but may use another multi-cylinder engine, for example, a six-cylinder engine, an eight-cylinder engine or a twelve-cylinder engine.

In the engine apparatus of the above aspect, the controller may increase the likelihood that the in-cylinder injection mode or the port injection mode is likely to be continued when the misfire count after elapse of the predetermined time period is not less than a second predetermined number of times that is smaller than the predetermined number of times, compared with the likelihood when the misfire count is less than the second predetermined number of times. The second predetermined number of times may be set to provide a smaller value at the long light load operation time in the failure diagnosis process than a value at the short light load operation time. The engine apparatus of this aspect uses the second predetermined number of times corresponding to the light load operation time. This increases the opportunities of performing the failure diagnosis process for the in-cylinder injection valve or the port injection valve in the case of a relatively long light load operation time and thereby ensures the more reliable detection of a failure of the in-cylinder injection valve or the port injection valve.

The engine apparatus of the above aspect may further include an exhaust gas recirculation system that is configured to perform exhaust gas recirculation to recirculate an exhaust gas of the engine to an intake gas. The controller may set the in-cylinder injection mode only when the exhaust gas recirculation is not performed, and the controller may increase a likelihood that the in-cylinder injection mode is likely to be continued at the long light load operation time in the failure diagnosis process for the in-cylinder injection valve, compared with the likelihood at the short light load operation time. The engine apparatus of this aspect sets the in-cylinder injection mode only when the exhaust gas recirculation is not performed. This is because setting the in-cylinder injection mode (not to inject the fuel from the port injection valve) in the course of the exhaust gas recirculation is likely to cause a deposit due to the recirculated exhaust gas to adhere to and to be accumulated at an outlet of the port injection valve. This is likely to provide a relatively low frequency of setting the in-cylinder injection mode. Increasing the likelihood that the in-cylinder injection mode is likely to be continued is thus of greater significance at the long light load operation time in the failure diagnosis process for the in-cylinder injection valve, compared with at the short light load operation time.

The following describes the correspondence relationship between the primary components of the embodiment and the primary components of the present disclosure described in Summary. The engine 12 of the embodiment corresponds to the "engine"; and the electronic controller 70 corresponds to the "controller".

The correspondence relationship between the primary components of the embodiment and the primary components of the present disclosure, regarding which the problem is described in Summary, should not be considered to limit the components of the present disclosure, regarding which the problem is described in Summary since the embodiment is only illustrative to specifically describes the aspects of the present disclosure, regarding which the problem is described in Summary. In other words, the present disclosure, regarding which the problem is described in Summary, should be interpreted on the basis of the description in the Summary, and the embodiment is only a specific example of the present disclosure, regarding which the problem is described in Summary.

The aspect of the present disclosure is described above with reference to the embodiment. The present disclosure is, however, not limited to the above embodiment but various modifications and variations may be made to the embodiment without departing from the scope of the present disclosure.

In some embodiments, the technique of the present disclosure is applicable to the manufacturing industries of engine apparatus.

The invention claimed is:

1. An engine apparatus, comprising:

a multi-cylinder engine that includes an injection valve provided to inject a fuel; and a controller configured with programming to control the engine, wherein in an injection mode where the fuel is injected from the injection valve, the controller performs a failure diagnosis process for the injection valve, wherein the failure diagnosis process increases a misfire count of the engine when a time variation in a rotation of the engine by a predetermined amount during an ignition cycle is equal to or greater than a predetermined time variation, and determines that the injection valve has a failure when the misfire count is equal to or greater than a first predetermined number of times over a time period including a plurality of ignition cycles, the controller determines that the multi-cylinder engine is in a light load ignition cycle if a volume efficiency of the multi-cylinder engine is less than a reference value during the ignition cycle, and the controller determines whether continuation of the injection mode is needed based on a comparison of the misfire count and a second predetermined number of times, wherein the second predetermined number of times is less than the first predetermined number of times and is determined based on a number of the light load ignition cycles within the time period, wherein the second predetermined number of times is inversely proportioned to a ratio of the number of the light load ignition cycles to a total number of ignition cycles within the time period.

2. The engine apparatus according to claim 1, further comprising:

an exhaust gas recirculation system that is configured to perform exhaust gas recirculation to recirculate an exhaust gas of the engine to an intake gas, wherein the controller sets the injection mode only when the exhaust gas recirculation is not performed.

3. The engine apparatus according to claim 1, further comprising:

an exhaust gas recirculation system that is configured to perform exhaust gas recirculation to recirculate an exhaust gas of the engine to an intake gas, wherein the controller sets the injection mode only when the exhaust gas recirculation is not performed.

4. The engine apparatus according to claim 1, wherein the injection valve is an in-cylinder injection valve provided to inject the fuel in a cylinder, and the injection mode is an in-cylinder injection mode where the fuel is injected from only the in-cylinder injection valve.

5. The engine apparatus according to claim 1, wherein the injection valve is a port injection valve provided to inject the fuel into an intake port, and the injection mode is a port injection mode where the fuel is injected from only the port injection valve.

* * * * *